United States Patent [19]

Manschitz

[11] Patent Number: 4,998,588

[45] Date of Patent: Mar. 12, 1991

[54] HAND TOOL WITH A SHIFTING GEAR UNIT

[75] Inventor: Erwin Manschitz, Puchheim, Fed. Rep. of Germany

[73] Assignee: Hilti Aktiengesellschaft

[21] Appl. No.: 448,018

[22] Filed: Dec. 8, 1989

[30] Foreign Application Priority Data

Dec. 9, 1988 [DE] Fed. Rep. of Germany ..... 3841515

[51] Int. Cl.[5] ..... B25D 11/00

[52] U.S. Cl. ..... 173/47; 173/104; 173/117

[58] Field of Search ..... 173/47, 48, 15, 104, 173/109, 114, 117; 74/473 R, 473 P, 102, 105, 107, 34

[56] References Cited

U.S. PATENT DOCUMENTS 994,627 6/1911 Workman, Sr. ..... 74/34

3,828,865 8/1974 Schnizler, Jr. ..... 173/104

FOREIGN PATENT DOCUMENTS 2029614 12/1971 Fed. Rep. of Germany ..... 173/48

*Primary Examiner*—Hien H. Phan
*Assistant Examiner*—John M. Husar
*Attorney, Agent, or Firm*—Toren, McGeady & Associates

[57] ABSTRACT

A hand tool has a shifting gear unit containing an output drive shaft. The drive shaft can be coupled with different gears by a connecting device so that a coupled gear drives the shaft. The connecting device is displaced by a slide and the slide is, in turn, displaced by a rotatable handle. Drive cams on the handle seat in engagement recesses in the slide. The drive cams and engagement recesses are spaced equal distances apart, so that as the handle is rotated, the drive cams, one after the other, entrain the engagement recesses and move the slide.

5 Claims, 4 Drawing Sheets

HAND TOOL WITH A SHIFTING GEAR UNIT

BACKGROUND OF THE INVENTION

The present invention is directed to a hand tool with a shifting gear unit containing gears arranged on an output drive shaft. The gears can be selectably coupled by a connecting or shifting device with the output drive shaft so that the gear rotates the shaft. The connecting or shifting device includes a slide actuatable by a rotatable handle.

Hand tools, such as motor driven drills, often contain a gear box for providing different operating speeds or different functions. As an example, DE-PS 1 602 712 discloses a drill with a two-speed gear shift. This known drill has a connecting or shifting device for selectively coupling one of two gears with an output drive shaft so that the gears are fixed to and rotate the shaft. The shifting action is effected by a slide. The slide forming a part of the shifting device is actuated by means of a rotatable handle. A drive cam, arranged eccentrically relative to the axis of rotation of the handle, engages a closed slot in the slide for displacing the slide. As a result, rotation of the handle leads to a displacement of the slide. The selected shifting position is maintained by means of a ball catch cooperating with the handle.

This known hand tool has the disadvantage that the handle displaces the slide only along a small path corresponding to the eccentric arrangement of the drive cam, whereby this known arrangement is not suitable for shifting a multiple-speed gear unit with a correspondingly larger displacement path. Means for providing larger displacement paths, known from other technical fields, are susceptible to disturbances in that they are unsuitable for use in hand tools of the type to which the present invention is directed.

SUMMARY OF THE INVENTION

The primary object of the present invention is to provide an actuating device for a gear box in a hand tool where the actuating device is distinguished by a large displacement path and in that it is economical and not susceptible to disturbance.

In accordance with the present invention, the actuating device includes a slide having a number of engagement recesses spaced one after the other in the displacing direction with the recesses being open toward a handle of a shifting device. The handle comprises drive cams arranged around and equally radially spaced from its rotational axis and with the spacing of the engagement recesses corresponding to the angular spacing between the drive cams. The drive cams can be moved into the engagement recesses with the movement of the handle. The engagement recesses, open toward the handle, permit the drive cams to seat in the engagement recesses, one after the other, as the handle is rotated. Depending on the length of the required displacement path, two or more engagement recesses and drive cams are provided. The production and arrangement of the engagement recesses and drive cams involve a considerably lower production cost as compared with toothed interengagement.

Preferably, the drive cams are arranged angularly apart in the range of 60° to 90°. On one hand, an operationally reliable and seating in the engagement recesses is insured and, on the other hand, a greater displacement path per drive cam is provided by means of this angular offset of the cams. Moreover, the drive cams and also the engagement recesses are spaced far enough apart so that large tolerances are possible, contributing to low production costs and resistance to disturbances.

Advantageously, the drive cams extend parallel to the axis of rotation. Such an arrangement enables a compact construction of the type desirable for use in hand tools.

It has proven to be particularly simple and advisable for a three-speed gear unit to use two drive cams and two engagement recesses. Preferably, the slide is formed as a C-shaped section with the engagement recesses located in one leg of the C-shaped section facing toward the other leg. This arrangement of the slide is advantageous particularly in connection with drive cams extending parallel to the axis of rotation. In addition, the C-shaped section enables a positive-locking support of the handle which is fixed with respect to displacement on the axis of rotation, so that separate support means are not needed. A C-shaped section can be formed economically by bending.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described a preferred embodiment of the invention.

DETAILED DESCRIPTION OF THE INVENTION

Figure 1:
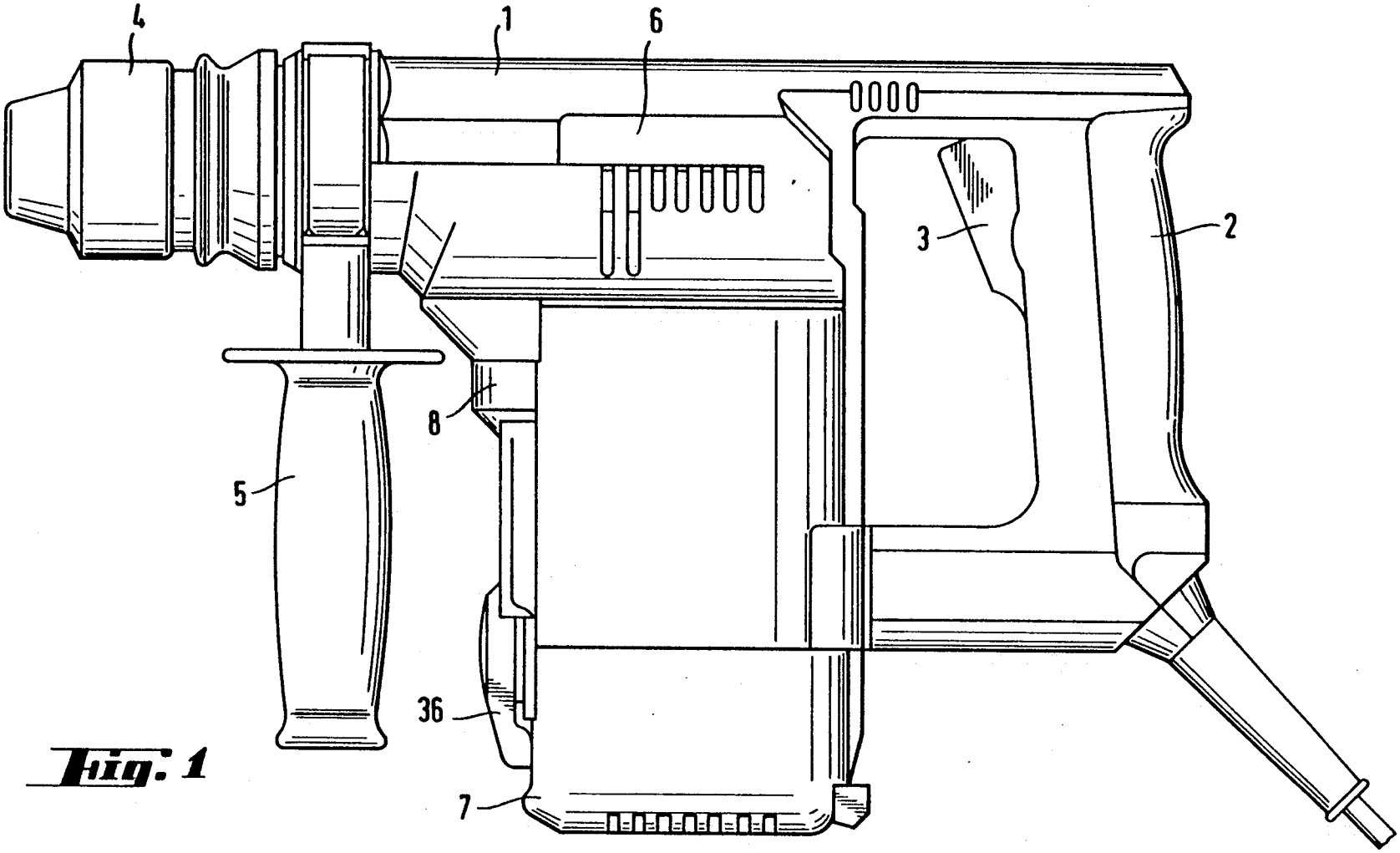
FIG. 1 is a side elevational view of a hammer drill.

The hammer drill, shown in FIG. 1, includes a housing 1 having a front end at the left for receiving a tool and a rear end at the right with a handle 2 located at the rear end. Handle 2 has an electrical on/off switch 3. A tool holder 4 is located at the front end and is rotatable relative to the housing 1. A tool, not shown, can be secured within the tool holder for effecting drilling. Adjacent the front end of the housing 1, there is a side handle 5 projecting laterally outwardly from the housing and located close to the tool holder. The housing 1 contains a striking mechanism space 6, a motor space 7, and a gear unit space 8.

Figure 2:
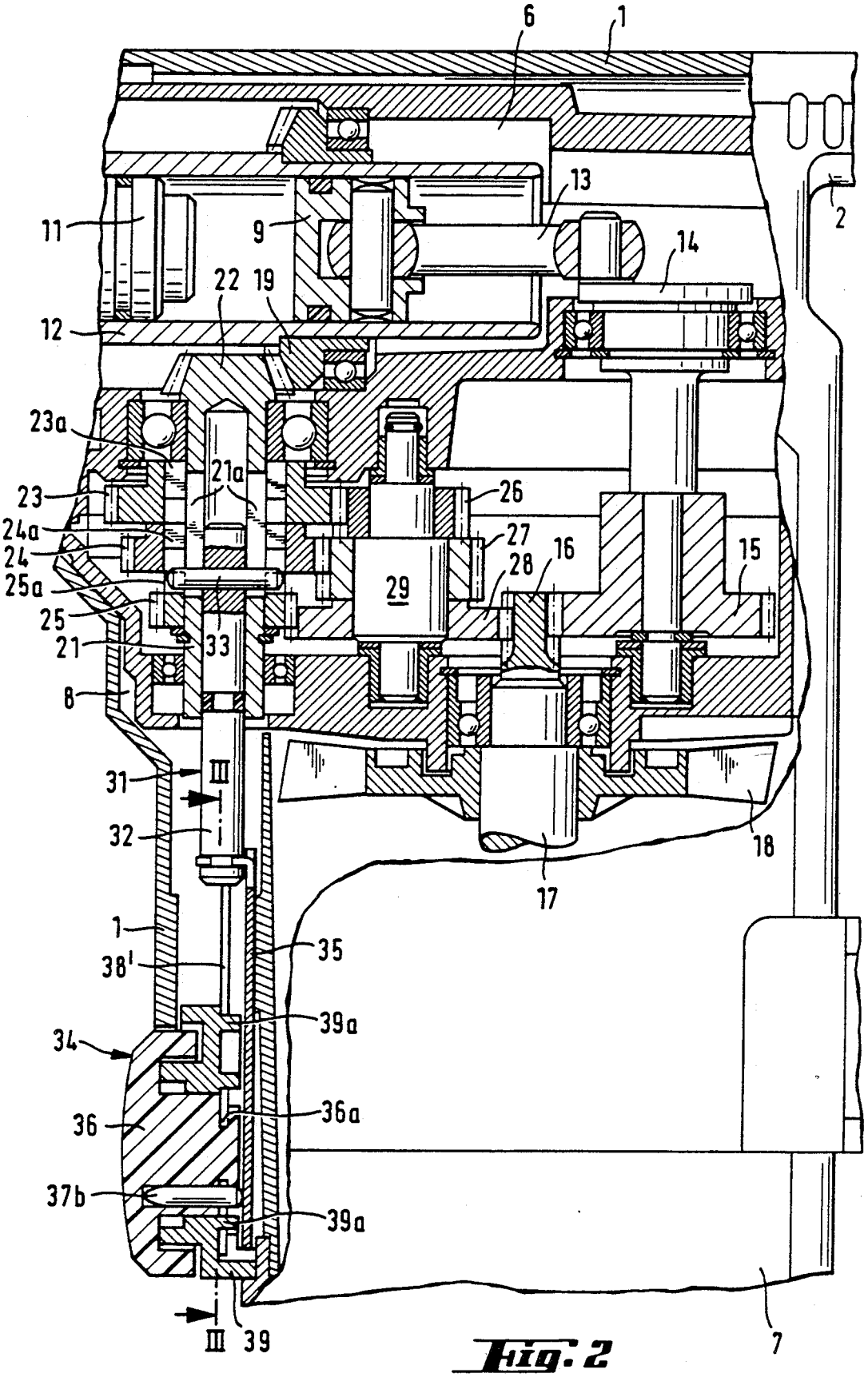
FIG. 2 is an enlarged sectional view through a gear box and a striking mechanism of the hammer drill illustrated in FIG. 1.

In FIG. 2, a three-speed gear unit is shown within the space 8 for selectively adjusting the rate of rotation or speed to be transmitted to the tool holder. In addition a striking mechanism, located within the space 6, produces percussive strokes transmitted to a tool inserted into the tool holder 4.

The striking mechanism includes an exciter piston 9 and a striking piston 11 located within a guide cylinder 12 so that reciprocating movement of the exciter piston is transmitted to the striking piston via an air cushion located in the guide cylinder between the two pistons. The transmission of the reciprocating movement by the air cushion is known. Exciter piston 9 receives motor-driven reciprocating movement from a connecting rod 13. Crankshaft 14 drives the connecting rod 13 and a drive gear 15 is fixed to the crankshaft for rotating it. Drive gear 15 is driven by a pinion 16 positioned on the end of a motor shaft 17. In addition, motor shaft 17 carries an impeller 18 for providing a cooling action.

Guide cylinder 12 is supported within the housing 1, so that it rotates relative to the housing. A bevel gear 19, mounted on the guide cylinder 12, transmits rotational movement to the cylinder. The rotational movement of the cylinder is transmitted from the guide cylinder 12 to the tool holder 4, and then to a tool clamped in the holder.

The three-speed gear unit includes an output drive shaft 21 rotatably supported in the housing. Output drive shaft 21 has a bevel pinion 22 at its upper end, as viewed in FIG. 2, and the bevel pinion meshes with the bevel gear 19. Three gears 23, 24, 25, each of a different size, are arranged adjacent to one another on the output drive shaft 21 and are freely rotatable relative to the shaft. Gears 23, 24, 25 mesh with gears 26, 27, 28 secured to rotate on a shaft 29, rotatably supported in the housing 1. The largest gear 28 engages with the pinion 16 whereby rotational movement is transmitted from the motor shaft 17 to the gears 23, 24, 25 via the gears 26, 27, 28.

Each gear 23, 24, 25 has a claw rim 23*a*, 24*a*, 25*a* enclosing the output drive shaft 21. Claw rims 23*a*, 24*a*, 25*a* are spaced from one another in the axial direction of the output drive shaft 21. A connecting or shifting device 31 is displaceably supported in a central borehole of the output drive shaft 21. The shifting device 31 comprises a sliding pin 32 and a transverse pin 33 fastened to it extending transversely of the output drive shaft. Transverse pin 33 projects through axial extending slots 21*a* in the output drive shaft 21, and has end portions which extend into the axial projections of the claw rims 23*a*, 24*a*, 25*a*. In the operating position, shown in FIG. 2, transverse pin 33 engages in the claw rim 25*a* with its end portions. As a result, the gear 25 and the output drive shaft 21 are connected together so that they rotate as a unit. Transverse pin 33 can also be displaced in the axial direction of the drive shaft 21 for engagement with the other claw rims 24*a*, 23*a* by the selective displacement of the shifting device 31. Accordingly, different speeds can be transmitted to the bevel gear 19.

An externally accessible adjustable actuating device 34 serves to displace the shifting device 31. Actuating device 34 includes an elongated slide 35 extending, as viewed in FIG. 2, downwardly from the lower end of sliding pin 32. A rotatable handle 36, forming a switching lever is connected to the lower end of the slide 35. For affording the switching action, handle 36 has drive cams 37*a*, 37*b* spaced radially outwardly from the center of rotation of the handle, note FIG. 3. When the handle 36 is pivoted about the axis of rotation, the drive cams 37*a*, 37*b* enter, one after the other, into engagement recesses 38*a*, 38*b* of one leg 38 of the C-shaped section of slide 35. The engagement recesses 38*a*, 38*b* open toward the other leg 38' of the slide. Spacing T of the engagement recesses 38*a*, 38*b* corresponds to the angular spacing 1 between the drive cams 37*a*, 37*b*. As viewed in FIG. 3, the angular spacing a between the drive cams 37*a*, 37*b* is 60°. The displacement path obtainable in this manner is greater by the extent of the spacing T than when only one drive cam is available for displacement. Accordingly, as shown, a multiple-speed gear unit can be shifted with the speeds indicated by the symbols "1, 2, 3".

Figure 3:
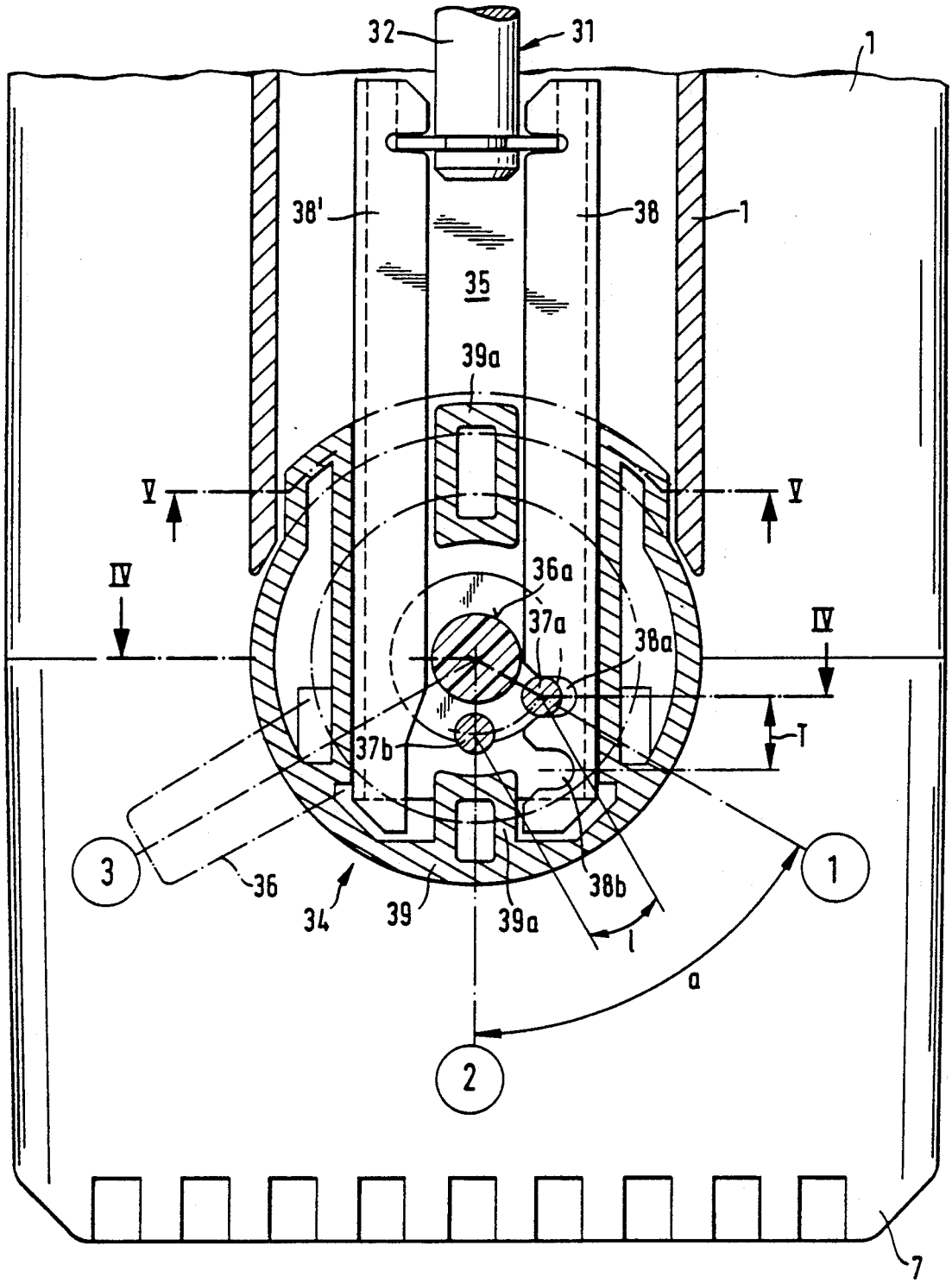
FIG. 3 is an enlarged sectional view through a shifting device for the gear box displayed in FIG. 2 and taken along the lines III—III in FIG. 2; with the contours of a handle not in the section plane indicated in dot-dash lines.
Figure 4:
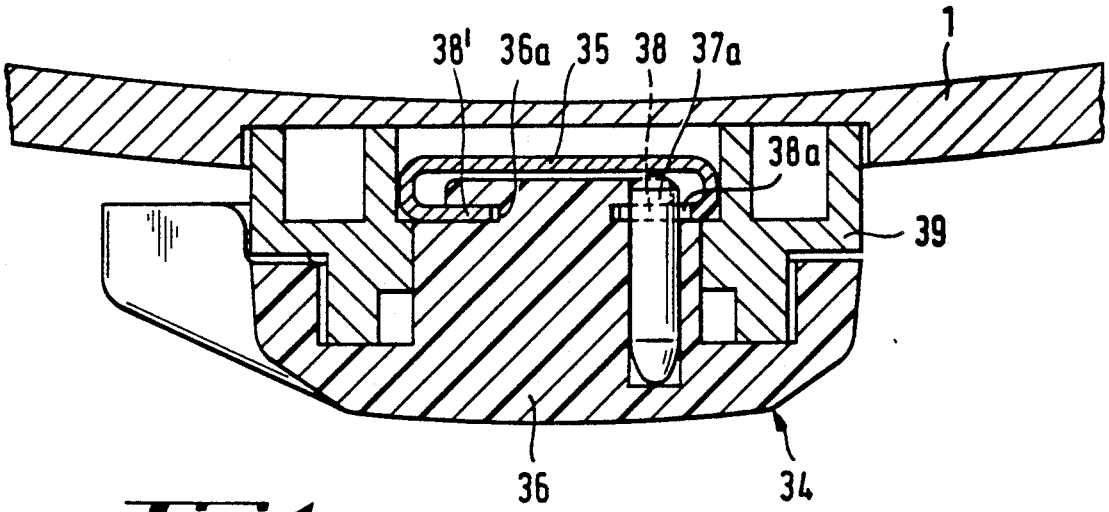
FIG. 4 is a sectional view through a portion of FIG. 3 and taken along lines IV—IV in FIG. 3.
Figure 5:
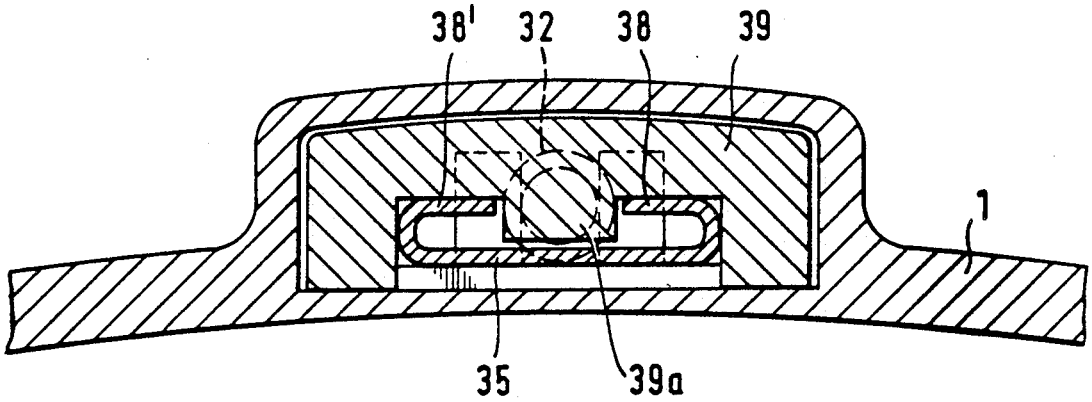
FIG. 5 is a sectional view through a portion of FIG. 3 taken along lines V—V.

In addition, the actuating device 34 includes a guide part 39 which is stationary relative to the housing 1. Guide part 39 serves, on the one hand, as a pivot bearing for the handle 36, note FIG. 4, and, on the other hand, projects with strip-like projections 39*a* between the legs 38, 38' of the slide 35, as shown in FIGS. 2, 3 and 5, for affording guidance. In addition, slide 35 is guided in an annular groove 36*a* of the handle 36, as depicted in FIG. 4.

While specific embodiments of the invention have been shown and described in detail to illustrate the application of the inventive principles, it will be understood that the invention may be embodied otherwise without departing from such principles.

I claim:

1. Hand tool, including a gear box containing a plurality of gears, (23, 24, 25) positioned on an output drive shaft (21), a switching device for selectively coupling said gears to said output drive shaft for selectively fixing one of said gear wheels to said output shaft for rotating said shaft, a slide (35) having a displacement direction and being displaceable relative to said output drive shaft for selecting the engagement of said gears with said shaft, a handle rotatably mounted about an axis extending transversely of the displacement direction with the axis extending through a plane containing said slide and engageable with said slide for displacing said slide, said slide includes engagement recesses (38*a*, 38*b*) in a surface facing said handle, said engagement recesses being spaced rectilinearly apart in the displacement direction, said handle includes drive cams (37*a*, 37*b*) spaced equidistantly radially from said handle axis, said drive cams spaced angularly apart about said handle axis, said engagement recesses being spaced apart a distance (T) corresponding to the angular spacing (1) of said drive cams, and said drive cams being engageable within said engagement recesses by rotating said handle about the axis thereof through an angle of less than 180°.

2. Hand tool as set forth in claim 1, wherein said drive cams (37*a*, 37*b*) are spaced angularly apart in the range of 60° to 90°.

3. Hand tool, as set forth in claim 2, wherein said drive cams (37*a*, 37*b*) extend parallel to the axis of rotation of said handle.

4. Hand tool, as set forth in claim 3, wherein said handle comprises two said drive cams (37*a*, 37*b*) and said slide contains two said engagement recesses (38*a*, 38*b*).

5. Hand tool, as set forth in claim 4, wherein said slide (35) is formed as a C-shaped section having two spaced legs, and said engagement recesses (38*a*, 38*b*) are located in one leg of said C-shaped section and are open toward the other leg thereof.

* * * * *